US005269699A

United States Patent [19]

Peloza

[11] Patent Number: 5,269,699

[45] Date of Patent: Dec. 14, 1993

[54] LOCKABLE ELECTRICAL CONNECTOR ASSEMBLY

[75] Inventor: Kirk B. Peloza, Wheaton, Ill.

[73] Assignee: Molex Incorporated, Lisle, Ill.

[21] Appl. No.: 895,763

[22] Filed: Jun. 9, 1992

[51] Int. Cl.[5] ..... H01R 11/22

[52] U.S. Cl. ..... 439/268; 439/849; 439/924

[58] Field of Search ..... 439/266, 268, 823, 832, 439/825, 845, 846, 848, 849, 850, 924

[56] References Cited

U.S. PATENT DOCUMENTS

| | | | |
|---|---|---|---|
| 2,701,350 | 2/1955 | Soreng | 439/849 |
| 2,768,361 | 10/1956 | Aquillon et al. | 439/849 |
| 3,550,067 | 12/1970 | Hansen | 439/850 |
| 3,852,864 | 12/1974 | Kirk, Jr. | 439/266 |
| 4,458,971 | 7/1984 | D'Urso et al. | 439/268 |
| 4,579,409 | 4/1986 | Enneper et al. | 439/845 |
| 4,897,055 | 1/1990 | Jurista et al. | 439/924 |
| 4,934,965 | 6/1990 | Buddrus | 439/845 |
| 4,976,635 | 12/1990 | Gottardo et al. | 439/849 |

FOREIGN PATENT DOCUMENTS

| | | | |
|---|---|---|---|
| 2512283 | 3/1982 | France | 439/924 |
| 0161095 | 12/1979 | Japan | 439/849 |

*Primary Examiner*—Gary F. Paumen
*Assistant Examiner*—Hien D. Vu
*Attorney, Agent, or Firm*—Stephen Z. Weiss

[57] ABSTRACT

A lockable electrical connector assembly includes a female terminal having a terminating end for coupling to an electrical conductor and a receptacle end for receiving a male blade terminal having a locking opening therein. The receptacle end has a generally rectangular cross-section defined by a top wall, a bottom wall and a pair of short side walls. The bottom wall has a resilient tongue which includes a locking tang for locking engagement with the opening in the male blade terminal and a release cam follower for pulling the locking tang out of the opening to release the terminal. A dielectric housing has a passageway of a generally rectangular cross-section for receiving the female terminal in either of two opposite orientations. The passageway is defined by top, bottom and opposite side interior walls. Both the top and bottom interior walls have cam surfaces engageable with the release cam follower of the female terminal upon relative movement between the housing and the female terminal to effect pulling of the locking tang out of the opening in the male blade terminal to release the terminal regardless of the orientation of the female terminal in the housing passageway. The top wall of the female terminal includes a locking tab, and both the top and bottom interior walls of the housing have locking surfaces engageable with the locking tab regardless of the orientation of the female terminal in the housing passageway. Top and bottom wall portions of the receptacle end of the female terminal are bowed inwardly toward each other to define convex curved contact surfaces for engaging opposite sides of the male blade terminal, the curved contact surfaces having radii offset longitudinally of the terminal so that the contact surfaces sequentially engage the male blade terminal to reduce the insertion forces thereof.

4 Claims, 3 Drawing Sheets

LOCKABLE ELECTRICAL CONNECTOR ASSEMBLY

FIELD OF THE INVENTION

This invention generally relates to the art of electrical connectors and, particularly, to a lockable electrical connector assembly which includes a female terminal for locking to a male terminal.

BACKGROUND OF THE INVENTION

Various electrical connector assemblies include a pair of mating dielectric housings respectively mounting complementarily interengaging male and female terminals formed from sheet metal material. The terminals have terminating portions terminated to respective electrical conductors, and the female terminal has a receptacle portion for receiving the male terminal. In one type of such electrical connector assembly, the receptacle portion of the female terminal is generally rectangularly shaped, with a top wall, a bottom wall and a pair of short side walls for receiving a flat male blade terminal. The top wall or the bottom wall of the receptacle portion of the female terminal includes a locking tang for locking engagement in an opening in the flat male blade terminal to secure or lock the blade terminal against removal from the receptacle portion of the female terminal.

Usually, the female terminal is inserted into a passageway of a dielectric housing and is locked therewithin for receiving the male blade terminal. The passageway is generally rectangularly shaped in cross-section complementary to the rectangular shape of the receptacle portion of the female terminal. Either the top or bottom interior wall of the housing passageway has a cam surface or actuator for engaging a cam follower of the female terminal operatively associated with the locking tang. Relative movement between the housing and the female terminal, such as by pulling on the housing, is effective to pull the locking tang of the female terminal out of the opening in the male blade terminal to release the locking interengagement between the terminals.

One of the problems with electrical connector assemblies of the character described is that the rectangularly configured female terminal must be inserted into the complementarily rectangularly shaped passageway in the housing in only one orientation, in order to properly locate the locking components between the terminal and the housing as well as to properly orient the releasing cam actuator and locking tang of the terminal. This becomes increasingly difficult with the ever-increasing miniaturization of such electrical connectors and often requires an operator or user to use a trial-and-error procedure to determine which orientation of the terminal is proper to effect insertion into the housing. This invention is directed to solving these problems by providing an electrical connector assembly with a rectangularly shaped female terminal insertable into a rectangularly shaped passageway in a housing in either of two orientations, 180° apart, and still have the connector perform the various functions described above. An operator, therefore, simply has to align the longer dimensions of the rectangular configurations.

SUMMARY OF THE INVENTION

An object, therefore, of the invention is to provide a new and improved lockable electrical connector assembly of the character described.

In the exemplary embodiment of the invention, the electrical connector assembly includes a female terminal having a terminating end for coupling to an electrical conductor and a receptacle end for receiving a male blade terminal having a locking opening therein. The receptacle end has a generally rectangular cross-section defined by a top wall, a bottom wall and a pair of short side walls. The bottom wall has a resilient tongue which includes a locking tang for locking engagement in the opening in the male blade terminal. The resilient tongue has a release cam follower for pulling the locking tang out of the opening in the male blade terminal to release the terminal.

A dielectric housing is provided with a passageway of a generally rectangular cross-section for receiving the female terminal inserted into the passageway in either of two opposite orientations. The passageway is defined by top, bottom and opposite side interior walls. Both the top and bottom interior walls have cam surfaces engageable with the release cam follower of the female terminal upon relative movement between the housing and the female terminal to effect the pulling of the locking tang out of the opening in the male blade terminal to release the terminal, regardless of the orientation of the female terminal in the housing passageway.

The female terminal also includes a locking tab projecting from the top wall thereof, and both the top and bottom interior walls of the housing have locking surfaces engageable with the locking tab to prevent removal of the female terminal from the passageway in the housing opposite its insertion direction. Therefore, the female terminal is locked within the housing regardless of the orientation of the female terminal in the housing passageway. In addition, both the top and bottom interior walls of the housing have ramp surfaces for biasing the locking tab inwardly to bypass the respective locking surface, regardless of the orientation of the female terminal, during insertion of the female terminal into the passageway.

Another feature of the invention is that the opposite side walls of the receptacle end of the female terminal are bowed inwardly toward each other to facilitate guiding the male blade terminal into the receptacle end. In this manner, the opening in the male blade terminal is aligned with the locking tang on the resilient tongue of the female terminal.

A further feature of the invention is that the top and bottom walls of the receptacle end of the female terminal also are bowed inwardly toward each other to define convex curved contact surfaces for engaging opposite flat sides of the male blade terminal. The curved contact surfaces have radii offset longitudinally of the terminal so that the contact surfaces sequentially engage the male blade terminal to reduce the insertion forces thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
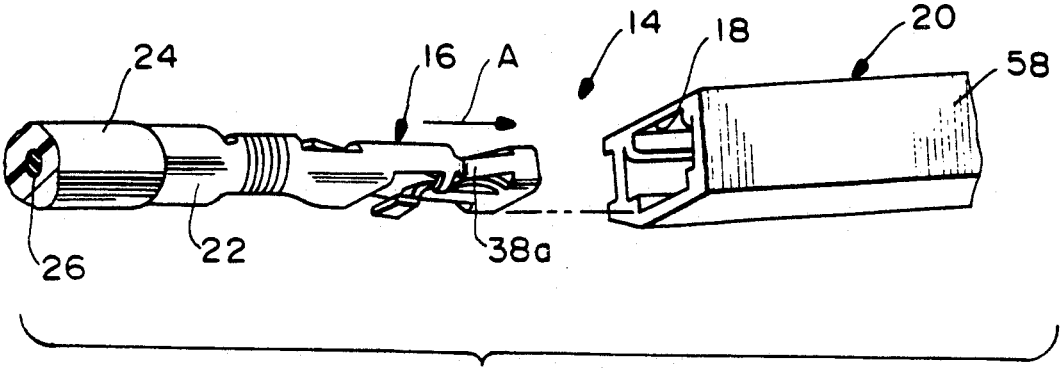
FIG. 1 is an exploded perspective view of a female connector assembly embodying the concepts of the invention.
Figure 2:
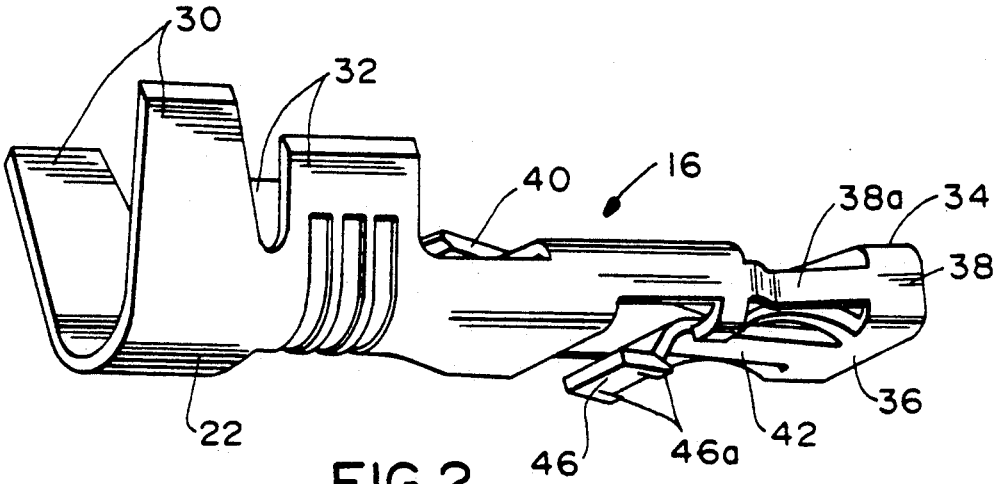
FIG. 2 is an enlarged perspective view of the female terminal of the invention.

Referring to the drawings in greater detail, and first to FIG. 1, the invention is embodied in a lockable electrical connector assembly, generally designated 14, which includes a female terminal, generally designated 16, insertable through an enlarged opening 18 in the rear of a dielectric housing, generally designated 20. Female terminal 16 has a terminating end 22 for coupling to an electrical cable 24 having a conductor 26. The female terminal also has a receptacle end 28 for receiving a male blade terminal having a locking opening therein, the male blade terminal being described in greater detail in relation to FIGS. 9-11 Suffice it to say at this point, the male blade terminal is of a conventional flat configuration of metal material with a locking hole or opening therein.

Referring to FIGS. 2-7, female terminal 16 is a unitary component stamped and formed of sheet metal material. Terminating end 22 includes two pairs of crimp arms 30 and 32. Crimp arms 30 are provided for crimping onto the outer insulation of electrical cable 24. Crimp arms 32 are provided for crimping onto conductor 26 of the cable. Receptacle end 28 of the female terminal is of a generally rectangular cross-section defined by a top wall 34, a bottom wall 36 and a pair of short side walls 38. At this point, it should be understood that such terms as "top", "bottom" and the like are used herein and in the claims hereof in order to facilitate a clear and concise understanding of the invention, it being understood that such terms are used for reference purposes in order to best describe the depictions in the drawings, and that the terminal, in fact, not only is usable in an omnidirectional fashion, but the invention contemplates that the receptacle can be inserted into its housing in either of two opposite orientations whereby the "top" wall may actually be the "bottom" wall, in use.

Figure 3:
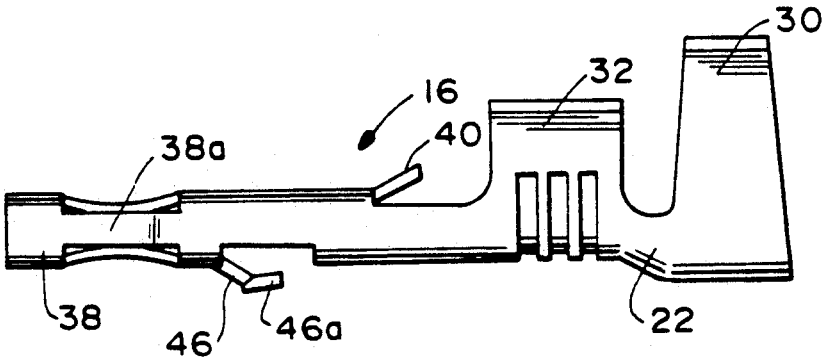
FIG. 3 is a side elevational view of the female terminal, oriented 180° opposite the orientation of FIG. 2.
Figure 4:
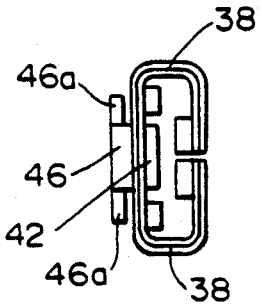
FIG. 4 is an end elevational view of the terminating end of the female terminal.
Figure 7:
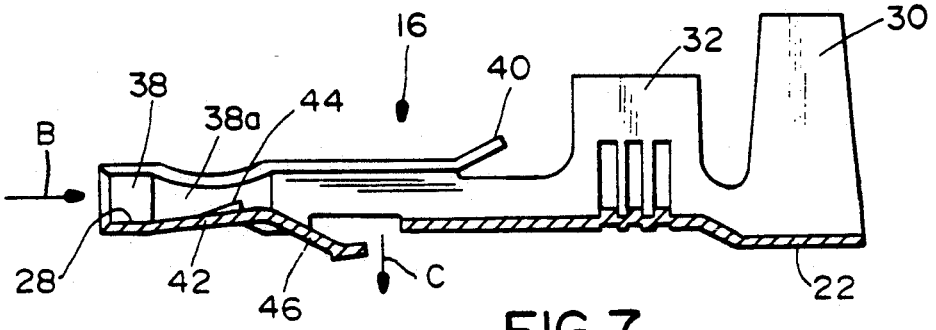
FIG. 7 is a central, axial section through the female terminal.

The top wall of female terminal 16 has a rearwardly angled, upwardly projecting locking tab 40 which, as will be described in greater detail, is effective to lock the terminal in position within dielectric housing 20. The upwardly projecting orientation of this locking tab is best seen in FIGS. 3 and 7. The locking tab prevents removal of the female terminal from the housing opposite its insertion direction, as indicated by arrow "A" in FIG. 1.

Figure 6:
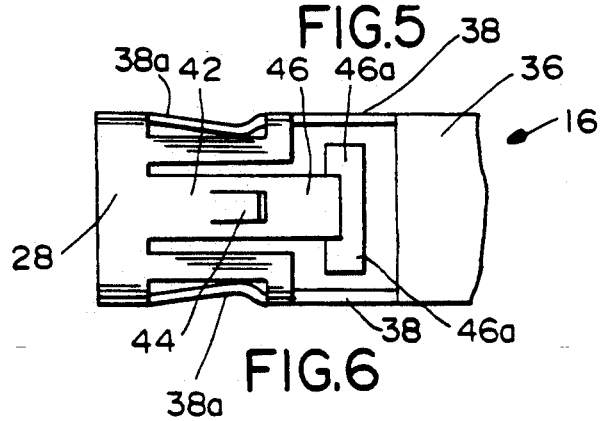
FIG. 6 is a fragmented bottom plan view of the terminating end of the female terminal.

Electrical connector assembly 14 is a "lockable" assembly in that female terminal 16 not only is locked against removal within housing 20, but the terminal is lockable to the mating male blade terminal. More particularly, a resilient tongue 42 is stamped and formed out of bottom wall 36 of the terminal. The tongue includes a rearwardly ramped, inwardly projecting locking tang 44 which is best seen in FIGS. 6 and 7. The rectangularly shaped receptacle end 28 of the terminal defines a rectangularly shaped receptacle (FIG. 7) for receiving the mating male blade terminal, in the direction of arrow "B" (FIG. 7). Locking tang 44 projects into the path of movement of the male blade terminal whereby the locking tang will snap into the locking opening in the male blade terminal, as described in greater detail hereinafter.

Resilient tongue 42 of female terminal 16 also has a cam follower 46 which projects downwardly from the tongue, with cam wing portions 46*a* at opposite transverse sides of the cam follower. Again, as will be described in relation to FIGS. 9-11, cam follower 46 (particularly wing portions 46*a*) is effective, upon engagement with appropriate cam surfaces on housing 20, in response to relative movement between the housing and the female terminal, to bias resilient tongue 42 and locking tang 44 downwardly in the direction of arrow "C" (FIG. 7). Downward movement of the resilient tongue pulls locking tang 44 out of the locking opening in the male blade terminal.

Figure 5:
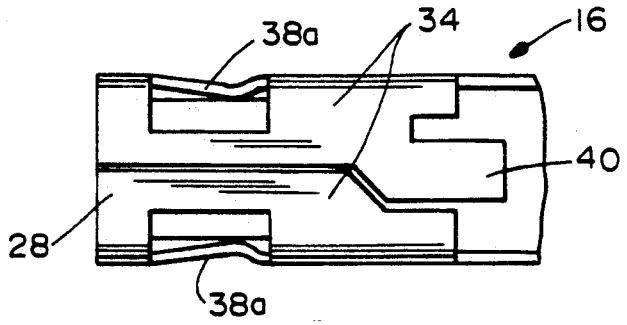
FIG. 5 is a fragmented top plan view of the terminating end of the female terminal.

Lastly, referring particularly to FIG. 5, portions 38*a* of side walls 38 of receptacle end 28 of the female terminal are bowed inwardly toward each other, as shown. This inward bowing of the side wall portions facilitates guiding the male blade terminal into the receptacle end of the female terminal and, thereby, guides the locking opening in the male blade terminal into alignment and interengagement with locking tang 44.

Figure 8:
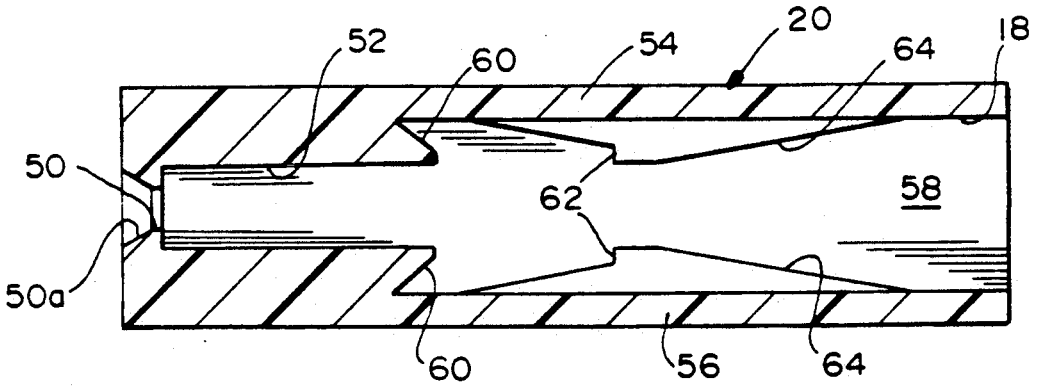
FIG. 8 is an axial section through the housing of the connector assembly.

Referring to FIG. 8, an axial section through housing 20 is illustrated. The housing has enlarged opening 18 (FIG. 1) at a rear or insertion end thereof, for receiving female terminal 16, and a generally rectangular opening 50 at a forward or mating end for receiving the male blade terminal. Opening 50 has a flared mouth 50*a* for guiding the male blade terminal into the housing. The housing has a generally rectangularly shaped passageway 52 communicating with opening 50 and into which the rectangularly shaped receptacle end 28 (FIG. of the female terminal eventually is positioned. The housing has a top wall 54, a bottom wall 56 and a pair of side walls 58. Both the top and bottom walls have cam surfaces 60 for interengagement with cam wing portions 46*a* of cam follower 46 of resilient tongue 42. Both top and bottom walls 54 and 56 also have locking surfaces 62 for engaging locking tab 40 of the female terminal. Still further, both top and bottom walls 54 and 56 have ramp surfaces 64 for biasing locking tab 40 inwardly to bypass locking surfaces 62 during insertion of the female terminal into passageway 52. It should be noted that FIG. 8 (along with FIGS. 9–11) is an axial sectional view through housing 20, but the section is offset transversely from the exact center of the housing. In other words, locking surfaces 62 and ramp surfaces 64 are shown in elevation, and these surfaces are in the center of the top and bottom walls for engaging locking tab 40 which is in the center of female terminal 16. Cam surfaces 60 are provided on both sides of the center of the housing, on both the top and bottom walls, because wing portions 46*a* are offset to each side of the center of the female terminal, as best seen in FIG. 6.

From the foregoing description of housing 20 in FIG. 8, it can be understood that the configuration of the interior of top and bottom walls 54 and 56 on the interior of the housing are mirror images of each other so that female terminal 16 can be inserted into the housing in either of two opposite directions 180° apart. Each of the top and bottom walls have locking surfaces 62 and ramp surfaces 64 for operative association with locking tab 40 of the female terminal, regardless of the orientation of the terminal. Likewise, each of the top and bottom walls have cam surfaces 60 for operative association with cam wing portions 46*a* of cam follower 46 of resilient tongue 42 on the female terminal, regardless of the orientation of the terminal. Therefore, a user does not have to use a trial-and-error procedure to determine which orientation is proper for the housing to receive the terminal.

Figure 9:
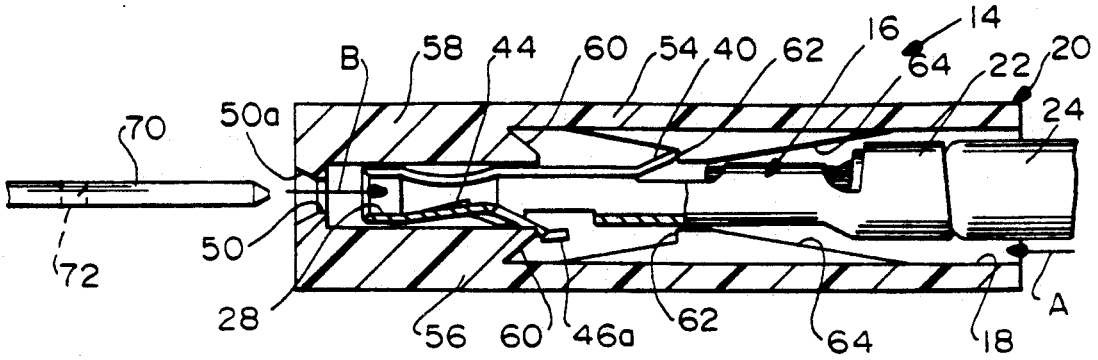
FIG. 9 is an axial section through the housing, with the female terminal inserted thereinto and partially in section, and with a terminating end of a male blade terminal about to be inserted into the connector assembly.
Figure 10:
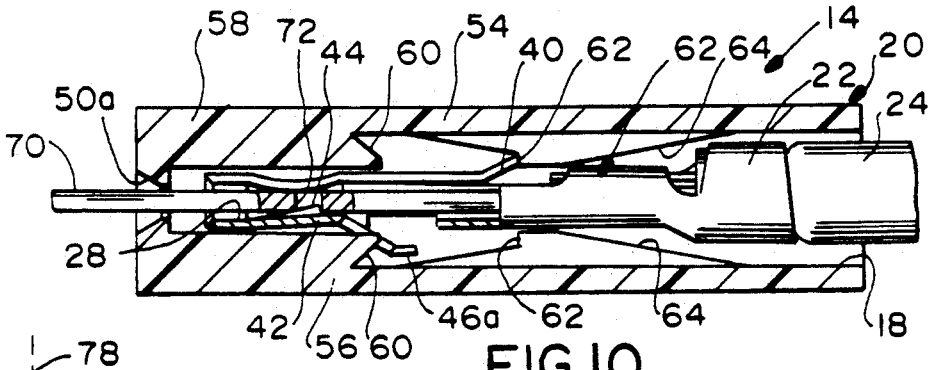
FIG. 10 is a view similar to that of FIG. 9, with the male terminal fully inserted into the receptacle end of the female terminal.
Figure 11:
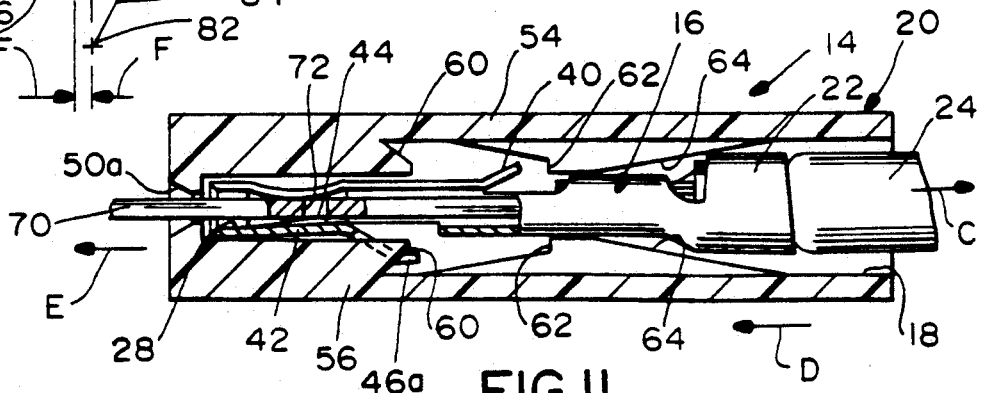
FIG. 11 is a view similar to that of FIG. 10, with the housing and female terminal relatively moved to unlock the male blade terminal.

FIGS. 9–11 show the sequence of assembling female terminal 16 into housing 20, the insertion of a male blade terminal 70 into the connector assembly, and the relative movement between the female terminal and the housing for effecting release of the male blade terminal.

More particularly, FIG. 9 shows female terminal 16 having been inserted into housing 20 in the direction of arrow "A". It can be seen that locking tab 40 has snapped into locking engagement behind locking surface 62 on the interior of top wall 54 of the housing. This prevents the female terminal from being pulled back out of the housing, opposite the direction of arrow "A". Male blade terminal 70 is shown about to be inserted through opening 50 in the housing, in the direction of arrow "B". The male blade terminal is of a conventional flat configuration, but the terminal includes a locking opening or hole 72 generally centrally thereof.

FIG. 10 shows male blade terminal 70 fully inserted into female terminal 16, with locking tang 44 of locking tongue 42 snapped into locking opening 72 of the male blade terminal. Again, locking tab 40 and locking surface 72 prevent the female terminal from backing out of the housing during insertion of the male blade terminal.

In order to release male blade terminal 70, reference is made to FIG. 11 wherein it can be seen that housing 20 and female terminal 16 have been relatively moved, as by pulling on the terminal in the direction of arrow "C", and pulling on the housing in the direction of arrow "D". This relative movement causes cam wing portions 46*a* to ride down cam surfaces 60 of bottom wall 56 of the housing and, thereby, pulling locking tongue 42 downwardly therewith, and pulling locking tang 44 out of locking opening 72 in the male blade terminal. The male blade terminal now can be pulled back out of connector 14 in the direction of arrow "E".

It should be understood that the functions described above in relation to FIGS. 9–11 would be the same if female terminal 16 was turned over and inserted into housing 20 in an inverted orientation, i.e. 180° opposite the orientation shown in FIGS. 9–11.

Figure 12:
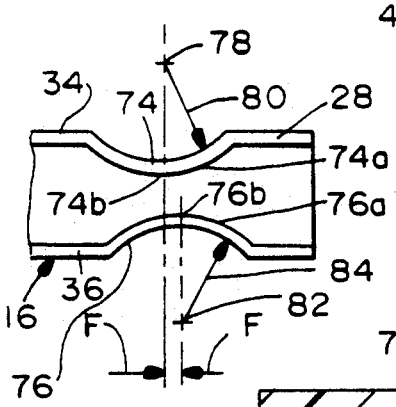
FIG. 12 is an enlarged, fragmented axial section through the terminating end of the female terminal.

Lastly, FIG. 12 shows a feature of the invention involving receptacle end 28 of female terminal 16 in order to reduce the insertion force of male blade terminal 70 thereinto. More particularly, top and bottom walls 34 and 36, respectively, of the female terminal are provided with inwardly bowed portions 74 and 76, respectively. These inwardly bowed portions define convex curved contact surfaces 74*a* and 76*a* for engaging opposite sides of male blade terminal 70. Inwardly bowed portion 74 is curved about an axis 78 on a radius 80. Inwardly bowed portion 76 is curved about an axis 82 on a radius 84. Radii 80 and 84 are equal, whereby convex curved contact surfaces 74*a* and 76*a* are substantially identical. However, as indicated by arrows "F", the radii are offset longitudinally of the female terminal to present tangent points 74*b* and 76*b* of inwardly bowed portions 74 and 76, respectively. The result of this configuration is that a sequential engagement is effected with the male blade terminal. In other words, inwardly bowed portion 76 first will engage the male blade terminal before inwardly bowed portion 74, resulting in a reduced insertion force on the male blade terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A lockable electrical connector assembly, comprising:

a female terminal having a longitudinal axis including a terminating end for coupling to an electrical conductor and a receptacle end for receiving a male blade terminal having a locking opening therein, the receptacle end having a generally rectangular cross-section defined by a top wall including two portions bent from the sidewalls and separated by a line generally parallel to the longitudinal axis, a bottom wall and a pair of short side walls, the bottom wall having a resilient tongue which includes a locking tang for locking engagement in the opening in the male blade terminal and a release cam follower for pulling the locking tang out of the opening to release the terminal;

a dielectric housing having a passageway of a generally rectangular cross-section for receiving the female terminal inserted into the passageway in either of two opposite orientations, the passageway being defined by top, bottom and opposite side interior walls, both the top and bottom interior walls having cam surfaces engageable with the release cam follower of the female terminal upon relative movement between the housing and the female terminal to effect said pulling of the locking tang out of the opening in the male blade terminal to release the terminal, regardless of which of two opposite orientations the female terminal takes in the housing passageway; and one portion of the top wall of the female terminal includes a locking tab projecting therefrom, and both the top and bottom interior walls of the housing have locking surfaces engageable with the locking tab to prevent removal of the female terminal from the passageway in the housing opposite its insertion direction, regardless of the orientation of the female terminal in the housing passageway.

2. The lockable electrical connector assembly of claim 2 wherein both the top and bottom interior walls of the housing have ramp surfaces for biasing the locking tab inwardly to bypass the respective locking surface, regardless of the orientation of the female terminal, during insertion of the female terminal into the passageway.

3. The lockable electrical connector assembly of claim 1 wherein at least portions of said opposite side walls of the receptacle end of the female terminal are bowed inwardly toward each other to facilitate guiding the male blade terminal into the receptacle end of the female terminal and, thereby, the locking opening in the male blade terminal into alignment with the locking tang on the resilient tongue of the female terminal.

4. The lockable electrical connector assembly of claim 1 wherein at least portions of said top and bottom walls of the receptacle end of the female terminal are bowed inwardly toward each other to define convex curved contact surfaces for engaging opposite sides of the male blade terminal, the curved contact surfaces having radii offset longitudinally of the terminal so that the contact surfaces sequentially engage the male blade terminal to reduce the insertion forces thereof.

* * * * *